US005738695A

United States Patent [19]

Harmer et al.

[11] Patent Number: 5,738,695

[45] Date of Patent: Apr. 14, 1998

[54] ABRASIVE ARTICLE CONTAINING AN INORGANIC PHOSPHATE

[75] Inventors: Walter L. Harmer, Arden Hills; Kwok-Lun Ho, Woodbury, both of Minn.

[73] Assignee: Minnesota Mining and Manufacturing Company, St. Paul, Minn.

[21] Appl. No.: 795,966

[22] Filed: Feb. 6, 1997

Related U.S. Application Data

[63] Continuation of Ser. No. 545,984, Oct. 20, 1995, abandoned.

[51] Int. Cl.[6] ..... B24D 3/34

[52] U.S. Cl. ..... 51/295; 51/297; 51/309; 451/28; 451/59

[58] Field of Search ..... 51/293, 295, 297, 51/309; 451/28, 59

[56] References Cited

U.S. PATENT DOCUMENTS

| | | | |
|---|---|---|---|
| 2,216,135 | 10/1940 | Rainier . | |
| 2,243,049 | 5/1941 | Kistler et al. . | |
| 2,408,319 | 9/1946 | Kistler . | |
| 2,690,385 | 9/1954 | Richlin . | |
| 2,811,430 | 10/1957 | Gregor et al. . | |
| 2,939,777 | 6/1960 | Gregor et al. . | |
| 2,949,351 | 8/1960 | Vigliatura, Jr. . | |
| 2,952,529 | 9/1960 | Stone . | |
| 3,030,198 | 4/1962 | Kibbey . | |
| 3,032,404 | 5/1962 | Douglass et al. . | |
| 3,246,970 | 4/1966 | Zimmerman . | |
| 3,770,401 | 11/1973 | Sheets, Jr. et al. . | |
| 4,420,532 | 12/1983 | Yamaguchi et al. | 428/329 |
| 4,770,671 | 9/1988 | Monroe et al. . | |
| 4,877,420 | 10/1989 | Buxbaum et al. . | |
| 5,009,674 | 4/1991 | Kunz et al. | 51/295 |
| 5,011,512 | 4/1991 | Wald et al. | 51/295 |
| 5,026,404 | 6/1991 | Kunz et al. | 51/295 |
| 5,061,295 | 10/1991 | Hickory et al. . | |
| 5,078,753 | 1/1992 | Broberg et al. | 51/298 |
| 5,096,983 | 3/1992 | Gerber . | |
| 5,116,392 | 5/1992 | Selgrad et al. . | |
| 5,441,549 | 8/1995 | Helmin . | |

FOREIGN PATENT DOCUMENTS

| | | |
|---|---|---|
| 0 071 723 A3 | 2/1983 | European Pat. Off. . |
| 0 304 616 | 3/1989 | European Pat. Off. . |
| 487287 | 6/1938 | United Kingdom . |
| 826729 | 1/1960 | United Kingdom . |
| 994484 | 6/1965 | United Kingdom . |

OTHER PUBLICATIONS

Patent Abstracts of Japan, vol. 17, No. 142 and Derwent Abstract No. 92–418273 for JP 4311772, Nov. 4, 1992.

Patent Abstracts of Japan, vol. 13, No. 163 and Derwent Abstract No. 89–051876 for JP 64002868, Jan. 6, 1989.

Derwent Abstract No. 77–80174Y for J 52115493, Sep. 28, 1977.

Derwent Abstract No. 93–141620 for SU 1731795, May 7, 1992.

Patent Abstracts of Japan, vol. 12, No. 466, AN. 88–261767 for Japanese Patent No. JP63191574, Aug. 9, 1988.

Kirk–Othmer Encyclopedia of Chemical Technology, 4th Editon, vol. 1, pp. 28–29 (1991) (no month).

Kirk–Othmer Encyclopedia of Chemical Technology, 3rd Edition, vol. 1, pp. 29–31 (1978) (no month).

I. S. Hong et al., "Coated Abrasive Machining of Titanium Alloys With Inorganic Phosphate Solutions", Trans. ASLE, 14 (1971) pp. 8–11 Jan. 1971.

Cadwell et al., "Grinding a Titanium Alloy With Coated Abrasives", ASME Paper 58–SA–44, Jun. 1958.

*Primary Examiner*—Deborah Jones

*Attorney, Agent, or Firm*—Doreen S. L. Gwin

[57] ABSTRACT

An abrasive article, and methods of making and using same, comprising an inorganic phosphate selected from the group consisting of an alkali metal metaphosphate, an alkaline earth metal metaphosphate, and a Group IIIA metal orthophosphate; the inorganic phosphate may be present in a peripheral coating layer of a coated abrasive article, or an abrasive slurry coating in a uniform thickness, or a structured abrasive article.

38 Claims, No Drawings

ABRASIVE ARTICLE CONTAINING AN INORGANIC PHOSPHATE

This is a continuation of application Ser. No. 08/545,984 filed Oct. 20, 1995 now abandoned.

BACKGROUND OF THE INVENTION

1. Field of the Invention

This invention relates to abrasive products comprising abrasive particles, binder, and an inorganic phosphate grinding aid, and to methods of making and using same. The grinding aid may be an alkali metal metaphosphate, an alkaline earth metal metaphosphate, or a Group IIIA metal orthophosphate. These abrasive products include bonded abrasives, coated abrasives, and nonwoven abrasives.

2. Description of the Related Art

In the competitive and economically significant field of abrasive products, a continuing desire exists to reduce manufacturing costs and increase performance of such products in efforts to seek and acquire competitive edge.

Abrasive products are generally known having abrasive particles adherently bonded to a sheet-like backing. For example, it is known to coat, in slurry form, a dispersion of abrasive particles in a liquid or semi-liquid binder upon the surface of a sheet-form substrate, and then curing the binder to anchor the coating as a single layer to the substrate. Alternatively, another known approach is to generally stratify the abrasive grains and binders into separate layers that are serially formed upon the sheet-form substrate, such as in coated abrasive articles, in such a way as to basically segregate the abrasive grains as a particulate monolayer sandwiched between underlying and overlaying binder layers.

More specifically, coated abrasive products typically have a backing substrate, abrasive grains, and a bonding system which operates to hold the abrasive grains to the backing. In a typical coated abrasive product, the backing is first coated with a layer of adhesive, commonly referred to as a "make coat", and then the abrasive grains are applied to the adhesive coating. The application of the abrasive grains to the make coat involves electrostatic deposition or a mechanical process which maximizes the probability that the individual abrasive particles are positioned with their major axis oriented perpendicular to the backing surface. As so applied, the abrasive particles optimally are at least partially embedded in the make coat. The resulting adhesive/abrasive grain layer is then generally solidified or set (such as by a series of drying or curing ovens) sufficient to retain the abrasive grains to the backing. After curing or setting the make coat, a second layer of adhesive, commonly referred to as a "size coat", is applied over the surface of the make coat and abrasive particles, and, upon setting, it further supports the particles and enhances the anchorage of the particles to the backing. Optionally, a "supersize" coat, which may contain grinding aids, can be applied over the cured size coat. In any event, once the size coat and supersize coat, if used, has been cured, the resulting coated abrasive product can be converted into a variety of convenient forms such as sheets, rolls, belts, and discs. As an optional enhancement, to mitigate any anticipated loading or clogging of the abrasive product with swarf (i.e., debris liberated from the workpiece during the abrading operation), a coating of anti-stick stearate also can be applied over the exterior of the abrasive coating, once formed, as suggested in *Kirk-Othmer Encyclopedia of Chemical Technology*, Fourth Ed., Vol. 1, (p. 29).

In many abrasive articles the binder includes a particulate filler as an adjuvant. Typically, the binder will comprise between 40 to 70 percent by weight particulate filler. The addition of the filler either increases the toughness and hardness of the binder and/or reduces the cost of the finished article, e.g., by decreasing the amount of binder required. The filler is typically an inorganic particulate material, generally having a particle size less than about 40 micrometers. Examples of common fillers in the abrasive industry include calcium carbonate, calcium oxide, calcium metasilicate, alumina trihydrate, silica, kaolin, quartz, and glass.

There exists a subclass of fillers, referred to as grinding aids, cutting aids, or generically as "active fillers". An active filler is typically a particulate material the addition of which to the binder has a significant affect on the chemical and physical processes of abrading which leads to improved performance. It is believed that active fillers will either (1) decrease the friction between the abrasive grains and the workpiece being abraded, and/or (2) prevent the abrasive grains from "capping", i.e. prevent metal particles from becoming welded to the tops of the abrasive grains, and/or (3) decrease the interface temperature between the abrasive grains and the workpiece, and/or (4) decrease the required grinding force.

Grinding aids can be especially effective in abrading stainless steel, exotic metal alloys slow to oxidize, and so forth. In some instances, a coated abrasive product containing a grinding aid in the binder can abrade up to 100% more stainless steel than a corresponding coated abrasive product in which the binder is devoid of a grinding aid. The reason, in theory, being that the activity of grinding metal by abrasive articles produces freshly formed, hot, and uncontaminated metal surfaces. If the newly formed, uncontaminated metal surface is not rapidly "contaminated", metal will transfer and adhere to the abrasive particle surface(s) causing "capping" which decreases grinding performance. One purpose and function of grinding aids is to prevent capping by rapidly contaminating the freshly formed metal surface. Grinding aids are normally incorporated into the bond resin(s) of the abrasive article. Grinding aids (active fillers) can be classified as physically active or chemically active. Cryolite, sodium chloride, and potassium tetrafluoroborate are known physically active grinding aids that melt between 500° and 1,000° C. which can form thin films on freshly formed metal. Chemically active grinding aids include iron pyrite, polyvinyl chloride, and polyvinylidene chloride which decompose when heated forming chemicals that rapidly react with the freshly formed metal surface.

Also, combinations of grinding aids in abrasive articles (grinding wheels) may produce more than a cumulative grinding effect. U.S. patents describing use of the combination of a sulfide salt and an alkali metal salt include U.S. Pat. Nos. 2,408,319; 2,811,430; 2,939,777; 3,246,970; and 5,061,295. Other patents that combine an inorganic salt containing fluorine, e.g. cryolite, and a salt such as ammonium chloride include U.S. Pat. Nos. 2,949,351 and 2,952,529.

Another type of grinding aid enhancement is described in U.S. Pat. No. 5,441,549 (Helmin) wherein the grinding aid effect of potassium tetrafluoroborate is enhanced by the addition of specific thermoplastics. Other descriptions of grinding aids include:

U.S. Pat. No. 2,216,135 (Rainier), which teaches a grinding wheel having as a grinding aid an anhydrous, water-soluble non-oxidizing inorganic alkali or alkaline earth metal salts whose melting points are within the range of 700° to 1200° C. These materials include sodium chloride, potassium chloride, anhydrous sodium carbonate, sodium sulfate, potassium sulfate, lithium sulfate, sodium pyrophosphate, potassium pyrophosphate, calcium chloride, calcium bromide, magnesium sulfate, barium chloride, barium bromide, magnesium chloride, magnesium bromide or strontium chloride.

U.S. Pat. No. 2,243,049 (Kistler), which teaches an abrasive body (grinding wheels) containing finely divided strongly acidic or potentially acidic inorganic compounds. Acid sulfates, phosphates or pyrophosphates are satisfactory, as are the ammonium, sodium, potassium, calcium, or barium salts thereof. Phosphorus pentoxide is also possible. The grinding aid constitutes about 7% of the bond. When used on metal work surfaces, the grinding aid reduces loading and increases the grain efficiency 40 to 100%.

U.S. Pat. No. 2,690,385 (Richlin), which teaches a metal cleaning cloth or felt impregnated with abrasive, sodium bisulfate and a humectant. Substitutes for the sodium bisulfate include ammonium chloride, ammonium phosphate, aluminum chloride, antimonious chloride, potassium bisulfate, oxalic acid, phosphoric acid and tartaric acid.

U.S. Pat. No. 3,030,198 (Kibbe), which discloses a grinding wheel containing potassium hexafluorophosphate as a grinding aid.

U.S. Pat. No. 3,032,404 (Douglass et al.), which discloses a grinding wheel containing as a grinding aid finely divided solid heavy metal phosphide. It is preferable to also include potassium aluminum fluoride in the grinding wheel.

U.S. Pat. No. 3,770,401 (Sheets et al.), which describes an abrasive body (grinding wheel) comprised of grit-sized particles of alumina or silicon carbide held together by a water-insoluble aluminum phosphate bonding matrix.

U.S. Pat. No. 5,096,983 (Gerbteaches the use of up to 5.0% of a water soluble salt such as sodium phosphate to retard the room temperature and eventual hardening of phenolic resole resins which are mixed with magnesium oxide with or without an ester functional hardening agent.

U.S. Pat. No. 5,116,392 (Selgrad et al.), which teaches a grinding aid having the formula: $uM_1 \cdot M_2 \cdot wHal \cdot xChal \cdot zPh$, where $M_1$ is a pure metal or mixture of alkali metal, alkaline earth metal and/or Al; $M_2$ is a pure metal or mixture of Zn, Mn, Fe except for Fe as chloride; Hal is a pure halogen or mixture of F, Cl, Br, I; Chal is chalcogenides, O and/or S; Ph is phosphate or more highly condensed phosphates of the formula $P_rO_s$ where r=1 to 10, preferably 1 to 2, s=4 to 20, preferably 4 to 7; and u, v, w, x or z=0 to 95%.

U.S. Pat. No. 4,770,671 (Monroe et al.) describes adding various types of grinding aids onto the surface of alpha-alumina-based ceramic abrasive grits in coated abrasives. In one example, Monroe et al. describe $K_2HPO_4$ as a grinding aid.

Also, commonly assigned U.S. patent application Ser. No. 08/214,394, filed Mar. 16, 1994, describes abrasive articles having a peripheral (outermost) coating comprised of grinding aid particles and a binder, where the grinding aid particles are individually coated with an inert, hydrophobic, hydrocarbon-containing substance, such as a fatty acid or fatty acid salt. The individually-coated grinding aid particles also may be incorporated into erodible grinding aid agglomerates, with a binder to adhere the grinding aid particles together, and these agglomerates can be incorporated into the make, size and/or supersize coats of a coated abrasive. Although a number of examples of grinding aid particles are disclosed in U.S. application Ser. No. 08/214,394, alkali metal or alkaline earth metal phosphates are not named.

Commonly assigned U.S. patent application Ser. No. 08/545,874 (Ho et al.), filed on even date with the present application, describes coated abrasive articles having an abrasive grain layer formed on a make coat, which, in turn, is coated with a size coat or a size coat and a super size coat, where the abrasive grain layer is comprised of abrasive grains and composite grains which contain inorganic non-abrasive particles bonded together by a metal salt of a fatty acid or colloidal silica, or combinations thereof.

Commonly assigned U.S. patent application Ser. No. 08/386,887 (Gagliardi et al.) relates to abrasive articles, and in particular to abrasive articles comprising a combination of grinding aids. In particular, the Gagliardi et al. application relates to abrasive articles comprising a combination of potassium tetrafluoroborate and a halogenated polymer in a binder, as well as abrasive articles comprising a combination of potassium tetrafluroborate in halogenated binder.

Titanium alloys, in particular, such as designed for aerospace applications, are extremely difficult to grind, even with conventional grinding aids. Although the high strength of these alloys is a major cause of poor grindability, chemical adhesion of the titanium to the abrasive grain is also thought a factor contributing to poor abrasive performance. These difficulties have been alleviated somewhat by use of certain grinding fluids, such as coolants or lubricants, used to flood the grinding interface between the abrasive article and workpiece. Materials used as grinding fluids for titanium include soluble cutting oils such as highly chlorinated cutting oils and buffered inorganic tripotassium phosphate solutions, the latter of which being described by I. S. Hong et al., "Coated abrasive machining of titanium alloys with inorganic phosphate solutions", Trans. ASLE, 14 (1971), pages 8–11. Additionally, a comparative study of grinding aid lubricants involving the use of among four inorganic salts $NaNO_2$, $KNO_2$, $Na_3PO_4$, and $K_3PO_4$, is described by Caldwell et al., "Grinding a titanium alloy with coated abrasives," ASME Paper 58-SA-44, June 1958. Although widely used in buffered solutions, the tripotassium phosphate salts have proven difficult to incorporate into resin-bonded systems due to their hygroscopic nature.

A variety of "phosphates" exist as salts of acids of phosphorus. The conventional nomenclature and associated chemical formulae of several common anions for these salts include the following:

orthophosphate=$PO_4^{3-}$ monohydrogen orthophosphate=$HPO_4^{2-}$ dihydrogen orthophosphate=$H_2PO_4^-$ metaphosphate=$PO_3^-$ pyrophosphate=$P_2O_7^{4-}$.

This terminology is applicable for purposes of this application.

SUMMARY OF THE INVENTION

The present invention provides abrasive articles having improved abrading efficacy and performance by containing an inorganic phosphate. The term "inorganic phosphate," as used herein, refers to an alkali metal metaphosphate, an alkaline earth metal metaphosphate, and/or a Group IIIA metal orthophosphate. The present invention relates to an abrasive article comprising (a) a plurality of abrasive particles, (b) at least one binder to which said plurality of abrasive particles are adhered; and (c) an inorganic phosphate selected from the group consisting of an alkali metal metaphosphate, an alkaline earth metal metaphosphate, and a Group IIIA metal orthophosphate.

In one aspect of the invention, the presence of an alkali metal metaphosphate or an alkaline earth metal metaphosphate in an abrasive article has been discovered to increase abrading efficacy and performance of the abrasive article. For purposes of this invention, alkali metals are comprised of the Periodic Table Group IA (i.e., Na, K, Li, Rb, Cs, and Fr). Alkaline earth metals are comprised of the Periodic Table Group IIA (i.e., Be, Mg, Ca, Sr, Ba and Ra), all exhibiting the oxidation state, +2. Therefore, inorganic metaphosphate compounds within the scope of this invention can be generally represented by the formula $M_x(PO_3)_y$, where the metal atom M is selected from among the Periodic Table Group IA, or Group IIA, and x and y will have values that provide an electrically neutral compound between the particular $M^{\oplus}$ ion(s) and the metaphosphate ion(s) (i.e. $PO_3^-$). M is the same type of metal atom for any given inorganic phosphate compound of the subject formula.

In yet another aspect of the invention, the presence of a Group IIIA metal orthophosphate in an abrasive article has been discovered to increase abrading efficacy and performance of a coated abrasive article, especially in titanium grinding, when added to a peripheral coating of a coated abrasive, as compared to conventional fillers such as calcium carbonate. For purposes of this invention, a Group IIIA metal means a metal selected from the Periodic Table Group IIIA (i.e., Al, B, Ga, In, and Tl). By "orthophosphate", it is meant the anion having the formula $PO_4^{3-}$.

In another aspect of this invention, there is a coated abrasive article including a substrate having abrasive grains adherently bonded thereto by at least one binding material, and a peripheral coating layer comprising particles of an inorganic phosphate. To illustrate, the present invention relates to a coated abrasive article comprising a substrate having a plurality of abrasive particles adherently bonded thereto by a binder, and a peripheral coating layer comprising a plurality of particles which comprise an inorganic phosphate, wherein said inorganic phosphate is selected from the group consisting of an alkali metal metaphosphate, an alkaline earth metal metaphosphate, and a Group IIIA metal orthophosphate; and a coated abrasive article comprising a cured abrasive slurry coating comprising a plurality of abrasive grains; a plurality of particles comprising an inorganic phosphate selected from the group consisting of an alkali metal metaphosphate, an alkaline earth metal metaphosphate, and a Group IIIA metal orthophosphate; and a binder.

More particularly, in this aspect, the inorganic phosphate can be advantageously used in a peripheral coating layer of a coated abrasive article or slurry-coated abrasive article. For purposes of this application, a "peripheral coating layer" means the outermost coating, i.e. the coating having an exposed and uncoated major surface, as disposed on the working side of a coated or slurry-coated abrasive article construction. The "working side" of the coated abrasive article being a side of the construction where the abrasive grains are adherently bonded to the backing. The peripheral coating generally is a size coat (without an overlaying supersize coat), a supersize coat, or an abrasive slurry coating, with the proviso that the layer in all cases represents the outermost layer of the abrasive article construction and is left uncoated by any other separate coating whether it is derived from the same composition or not.

In the instance of the peripheral coating also constituting an abrasive slurry coating, the abrasive particles are co-dispersed with the inorganic phosphate particles in a liquid or semi-liquid binder precursor and the resulting dispersion cast or coated upon the substrate, and then the binder precursor is cured, and the resulting comingled abrasive particle and grinding aid-containing hardened coating is left exposed and uncoated on its outer major surface. The abrasive slurry in this regard can be formed into a single thickness layer, or alternatively, the abrasive slurry can be shaped before completing hardening of the binder medium to impart a surface topography therein including three-dimensional geometric shapes to provide a structured abrasive.

The peripheral coating includes a binder, preferably a thermoset binder or resin, which serves as the continuous phase or medium by which the grinding aid particles, and any other dispersed additives and/or abrasive particles, are attached within and bound into the layer. The term "thermoset" resin, as used herein, means a cured resin that has been exposed to an energy source (e.g., heat and/or radiation) sufficient to make the resin incapable of flowing. The term "thermosetting" means an uncured thermoset resin. The term "thermoplastic resin" means a polymer material that is solid, that is possesses significant elasticity at room temperature and turns into a viscous liquid-like material at some higher temperature, the change being reversible. Also, the term "dispersed", or variants of this term, as used herein, does not necessarily denote a uniform distribution of the inorganic phosphate-containing grinding aid throughout the resinous binder of the peripheral coating, although uniform dispersions of such are contemplated in this invention.

A peripheral coating containing the inorganic phosphate grinding aid erodes during the abrading process so that fresh grinding aid is introduced to and replenished at the abrading interface. The peripheral coating may contain other non-abrasive additives to manage the erodability of the grinding aids in the peripheral coating. The peripheral coating preferred for this invention contains an epoxy binder and water insoluble sodium metaphosphate as grinding aid.

It is to be understood that the abrasive article of the invention includes not only coated abrasive articles and abrasive slurry-coated abrasives, but also bonded abrasives, and nonwoven abrasives. Bonded abrasives comprise a shaped mass of abrasive particles adhered together with a binder, which can be organic, metallic or vitrified, which, in the present invention, would also include a dispersion in the binder of the inorganic phosphate grinding aid. Thus, a bonded abrasive article of the present invention can comprise a shaped mass, wherein said shaped mass comprises a plurality of abrasive particles and an inorganic phosphate selected from the group consisting of an alkali metal metaphosphate, an alkaline earth metal metaphosphate, and a Group IIIA metal orthophosphate, adhered together with a binder. The bonded abrasive can be molded and shaped into a wide variety of useful grinding shapes before completely curing the binder, such as including a grinding wheel shape or a conical shape. A nonwoven abrasive of the invention involves dispersion of the inorganic metaphosphate grinding aid in a binder along with abrasive grains, adhered to the fibers of a lofty, open nonwoven web.

The inorganic phosphate grinding aid can be added to a binder of an abrasive article as individual particles or in agglomerate form where, in the latter form, individual particles of the filler are bound together with an agglomerate binder, such as a thermosetting resinous binder. The agglomerates, if used, should be erodible. By "erodible", it is meant that the agglomerate has the ability to break down in a controlled manner, for example, by fracture due to mechanical stress and/or by dissolving fully or in part under wet grinding conditions. "Wet" means grinding conditions where a water spray or flood is used. One preferred binder for such agglomerates is a metal salt of fatty acid, such as zinc stearate. Therefore, the present invention relates to an erodible grinding aid agglomerate comprising (a) a plurality of particles comprising an inorganic phosphate, said inorganic phosphate being selected from the group consisting of an inorganic phosphate selected from the group consisting of an alkali metal metaphosphate, an alkaline earth metal metaphosphate, and a Group IIIA metal orthophosphate, and (b) a binder adhering said inorganic phosphate particles together.

The inorganic phosphate is contained in an amount effective to increase the amount of workpiece surface removed by grinding a workpiece, such as a titanium workpiece, with an abrasive article of the invention as compared to the use of the same abrasive article construction except as devoid of the inorganic metal phosphate constituent.

Other advantages, in addition to the grinding enhancement, attributable to the use of an inorganic phosphate additive in an abrasive article include (1) its excellent rheology in both aqueous epoxy systems, allowing its incorporation into either size and/or supersize coats; and (2) ease to incorporate into an abrasive article.

In another aspect, the invention provides a method for making a coated abrasive article, comprising the steps of:

(a) applying a first binder resin precursor to a substrate;

(b) at least partially embedding a plurality of abrasive particles in said first binder resin precursor;

(c) at least partially curing said first binder resin precursor to form a make coat;

(d) applying, over said make coat and said plurality of abrasive particles, a second binder resin precursor and an inorganic phosphate selected from the group consisting of an alkali metal metaphosphate, an alkaline earth metal metaphosphate, and a Group IIIA metal orthophosphate; and (e) curing said second binder resin precursor to form a peripheral coating, and completely curing said first binder resin precursor.

In yet another aspect, the invention provides a method for making a coated abrasive article, comprising the steps of:

(a) applying a first binder resin precursor to a substrate;

(b) at least partially embedding a plurality of abrasive particles in said first binder resin precursor;

(c) at least partially curing said first binder resin precursor to form a make coat;

(d) applying, over said make coat and said plurality of abrasive particles, a second binder resin precursor; and (e) at least partially curing said second binder resin precursor to form a size coat;

(f) applying, over said size coat, a third binder resin precursor and an inorganic phosphate selected from the group consisting of an alkali metal metaphosphate, an alkaline earth metal metaphosphate, and a Group IIIA metal orthophosphate; and (g) curing said third binder resin precursor to form a peripheral coating, and completely curing said first and second binder resin precursors.

In a different aspect of the invention, there is a method of making a slurry-coated abrasive article comprising the steps of:

(a) applying a coating to a substrate, the coating comprising a binder resin precursor, a plurality of abrasive particles, and an inorganic phosphate selected from the group consisting of an alkali metal metaphosphate, an alkaline earth metal metaphosphate, and a Group IIIA metal orthophosphate; and (b) curing said binder resin precursor.

The present invention, in another aspect, relates to a method of using the abrasive articles of the invention to grind titanium, comprising:

(a) providing an abrasive article comprising an inorganic phosphate selected from the group consisting of an alkali metal metaphosphate, an alkaline earth metal metaphosphate, and a Group IIIA metal orthophosphate in a peripheral coating layer thereof, and a workpiece comprising titanium;

(b) frictionally engaging said peripheral coating layer of said abrasive article with a surface of said workpiece; and (c) moving at least one of said abrasive article and said workpiece relative to each effective to reduce the surface of said workpiece.

The incorporation of an inorganic phosphate into a peripheral coating of an abrasive article, in particular, endows the abrasive article with an unexpected abrading efficiency when compared to a similar abrasive containing conventional nonabrasive fillers for peripheral coatings, without unduly increasing cost.

DETAILED DESCRIPTION OF THE INVENTION

The coated and slurry-coated abrasive products of the present invention generally include conventional backings and binders for the coatings, as modified to contain an inorganic phosphate grinding additive. As will be shown, abrasive products of this invention have been found to demonstrate high performance in abrading workpieces, preferably metal workpieces, such as titanium.

The coated abrasive products of this invention can make use of backings, make coats, abrasive grains, size coats, supersize coats, and optional adjuvants, such as grinding aids, fillers, and other additives, which are known or conventional in making coated abrasive products; such materials or substances and their forms and use are described, for example, in *Kirk-Othmer*, loc. *cit*, p. 17–37, McKetta, J. J., Cunningham, W. A.; *Encyclopedia of Chemical Processing and Design*, Marcel Dekker, Inc., p. 1–19; and said U.S. Pat. Nos. 5,011,512 and 5,078,753, which descriptions are incorporated herein by reference.

The backing used as a base or substrate for abrasive products of this invention generally will be made of a sheet or film of a material that is compatible with the make coat or abrasive slurry coat and other elements or components of the abrasive product and that is capable of maintaining its integrity during fabrication and use of the abrasive product. Examples of backing materials are paper, fiber, polymeric film, woven and nonwoven fabric or cloth, and vulcanized fibre,. Specific weights, tensile strengths, and characteristics of some of such backings are set forth on p. 4 of the McKetta and Cunningham text, loc. cit. Still other examples of backings include U.S. Pat. No. 5,316,812 and European Patent Application No. 0 619 769. The backing may also contain a treatment or treatments to seal the backing, for example, to make them waterproof, and modify physical properties thereof. Also, reference is made to U.S. Pat. No. 5,011,512 describing specific, woven, polyester cloth backings of certain weights and saturated with a calcium carbonate-filled latex/phenolic resin coating (useful also as a make coat). The backing may also have an attachment means on its back surface to secure the resulting coated abrasive to a support pad or back-up pad. This attachment means can be a pressure sensitive adhesive or a loop fabric for a hook and loop attachment. Alternatively, there may be a intermeshing attachment system as described in the said U.S. Pat. No. 5,201,101. The back side of the abrasive article may also contain a slip resistant or frictional coating. Examples of such coatings include an inorganic particulate (e.g., calcium carbonate or quartz) dispersed in an adhesive.

The binder used to bind the inorganic phosphate component in a peripheral coating of an abrasive article, such as a size, supersize, or abrasive slurry coat, (also referred to as a "peripheral coating binder") generally will be resinous binder or adhesive. The resinous adhesive generally will be selected such that it has the suitable properties necessary for an abrasive article binder. Examples of typical resinous adhesives useful in this invention include thermosetting resins or thermoplastic resins. The peripheral coating binder may be the same as or different from the binder adhering the abrasive particles.

Suitable examples of thermosetting resins for use in this invention include, for example, phenolic resins, aminoplast resins having pendant α,β-unsaturated carbonyl groups, urethane resins, epoxy resins, ethylenically-unsaturated resins, acrylated isocyanurate resins, urea-formaldehyde resins, isocyanurate resins, acrylated urethane resins, acrylated epoxy resins, bismaleimide resins, fluorene modified epoxy resins, waxes, and mixtures thereof. These binders may also be useful to bond the abrasive grains together to form a bonded abrasive, or bond the abrasive grains to a backing to from a coated abrasive.

Phenolic resins are widely used in abrasive article binders because of their thermal properties, availability, cost and ease of handling. There are two types of phenolic resins, resole and novolac, and they can be used in this invention. Resole phenolic resins have a molar ratio of formaldehyde to phenol, of greater than or equal to 1:1, typically between 1.5:1.0 to 3.0:0. Novolac resins have a molar ratio of formaldehyde to phenol of less than to one to one. Examples of commercially-available phenolic resins include those available from Occidental Chemical Corp., Tonawanda, N.Y., under the trade designations "Durez," and "Varcum"; those available from Monsanto Co., St. Louis, Mo., under the trade designation "Resinox"; and those available from Ashland Chemical Inc., Columbus, Ohio, under the trade designations "Arofene" and "Arotap".

The aminoplast resins which can be used as binder in the make, size and supersize coats have at least one pendant α,β-unsaturated carbonyl group per molecule or oligomer. These materials are further described in U.S. Pat. Nos. 4,903,440 and 5,236,472, of which descriptions both are incorporated herein by reference.

Epoxy resins useful as binders in make, size or supersize coats have an oxirane ring and are polymerized by the ring opening. Such epoxide resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxy-propoxy)phenyl]propane (diglycidyl ether of bisphenol) and materials commercially available from Shell Chemical Co., Houston, Tex., under the trade designations "Epon 828," "Epon 1004," and "Epon 1001F" and from Dow Chemical Co., Midland, Mo., under the trade designations "DER 331," "DER 332," and "DER 334". Aqueous emulsions of the diglycidyl ether of bisphenol A have from about 50 to 90 wt. % solids, preferably 50 to 70 wt. % solids, and further comprise a nonionic emulsifier. An emulsion meeting this description is available from Shell Chemical Co., Louisville, Ky., under the trade designation "CMD 35201". Such aqueous epoxy emulsions are described as binder for grinding aids in EP 486308(Lee et al.), which is incorporated herein by reference. Other suitable epoxy resins include glycidyl ethers of phenol formaldehyde novolac (e.g., available from Dow Chemical Co., under the trade designations "DEN 431" and "DEN 438").

Ethylenically-unsaturated resins which can be used in the make, size or supersize coats include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. The ethylenically-unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically-unsaturated resins include those made by polymerizing methyl methacrylate, ethyl methacrylate, styrene, divinylbenzene, vinyl toluene, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate, or pentaerythritol tetramethacrylate, and mixtures thereof.

Other ethylenically-unsaturated resins include those of polymerized monoallyl, polyallyl, and polymethallyl esters and amides of carboxylic acids, such as diallyl phthalate, diallyl adipate, and N,N-diallyladipamide. Still other polymerizable nitrogen-containing compounds include tris(2-acryloxyethyl)isocyanurate, 1,3,5-tri-(2-methacryloxyethyl)-s-triazine, acrylamide, methylacrylamide, N-methylacrylamide, N,N-dimethyl-acrylamide, N-vinylpyrrolidone, and N-vinylpiperidone.

Acrylated urethanes are diacrylate esters of hydroxy terminated isocyanate extended polyesters or polyethers. Examples of commercially-available acrylated urethanes which can be used in the make, size and supersize coats include those available from Radcure Specialties Inc., Atlanta, Ga., under the trade designations "UVITHANE 782," "CMD 6600," "CMD 8400," and "CMD 8805". Acrylated epoxies which can be used are diacrylate esters of epoxy resins, such as the diacrylate esters of bisphenol A epoxy resin. Examples of acrylated epoxies include those commercially available from Radcure Specialties Inc., Atlanta, Ga., under the trade designations "CMD 3500," "CMD 3600," and "CMD 3700".

Bismaleimide resins which also can be used in the make, size or supersize coats are further described in U.S. Pat. No. 5,314,513 (Miller et al.), which description is incorporated herein by reference.

Suitable thermoplastic resins for use in this invention to bind the alkali metal or alkaline earth metal metaphosphate in a peripheral coating of a coated abrasive article include halogenated polymers. Examples of halogenated polymers useful in this invention include polyvinyl halides (e.g. polyvinyl chloride) and copolymers thereof, and polyvinylidene halides such as disclosed in U.S. Pat. No. 3,616,580; highly chlorinated paraffin waxes such as those disclosed in U.S. Pat. No. 3,676,092; completely chlorinated hydrocarbon resins such as those disclosed in U.S. Pat. No. 3,784,365; and fluorocarbons such as polytetrafluoroethylene and polytrifluorochloroethylene as disclosed in U.S. Pat. No. 3,869,834. The more preferred halogenated polymers are polyvinyl chloride, a vinyl chloride/vinyl acetate copolymer, and polyvinylidene chloride.

An example of a useful polyvinyl chloride is commercially-available under the trade designation "GEON 103EPF-76", which can be obtained from the Specialty Polymers & Chemicals Div. of B. F. Goodrich of Cleveland, Ohio. An example of a useful vinyl chloride/vinyl acetate copolymer is commercially available from Occidental Chemical Corp., Dallas, Tex., under the trade designation "OXY-0565".

Preferred halogenated polymers are solids having an average particle size of between 1 micrometers and 150 micrometers, and more preferably between 10 micrometers and 100 micrometers. The polymer particles can be round, or can be another selected shape.

The halogenated polymer binder, such as polyvinyl chloride or a copolymer thereof, preferably is used in latex form or is plasticized. An example of polyvinyl chloride latex is that commercially available from B. F. Goodrich, Cleveland, Ohio, under the trade designation "GEON 660-X14". In addition, a preferred abrasive article includes a peripheral coating comprising the inorganic phosphate, a plasticized polyvinylchloride, and a thermosetting binder. Useful thermosetting binders include epoxy binders, phenolic binders, melamine formaldehyde binders, acrylate binders, and latex binders, such as those described above. Plasticized materials, or "plastisols", are stable, pourable, cream-like dispersions of resin powders, e.g., polyvinyl chloride, in a plasticizer. Paste systems of polyvinyl chloride resins are formulated so that the plasticizer wets the resin particle at room temperature but only very slowly penetrates and solvates the resin. Upon heating, the paste systems fuse to provide a well plasticized resin. Plasticizers suitable for polyvinyl chloride generally are low viscosity, organic esters, for example, dioctyl phthalate, di-2-ethylhexyl phthalate, diisononyl phthalate, and triphenyl or diphenyl alkyl phosphate, and generally are 100% solids systems. Examples of such plasticizers useful for forming a plastisol with the halogenated polymer, such as polyvinyl chloride, include, for example, a diisononyl phthalate plasticizer, commercially available from Exxon Chemical Co., Houston, Tex., and a diphenyl alkyl phosphate plasticizer, commercially available from Monsanto Co., St. Louis, Mo., under the trade designation "Santicizer 141". These systems generally do not require an organic solvent and the total cure or fusion time is very short since no volatile solvents have to be removed prior to curing or fusion.

The types of abrasive particles or grains useful in this invention include aluminum oxide, diamond like carbon, fused alumina zirconia, titanium diboride, chromia, iron oxide, silica, tin oxide, garnet, ceria, flint, diamond, silicon carbide, cubic boron nitride (CBN), boron carbide, and the like. The term aluminum oxide includes alumina, heat treated alumina, and sintered alumina, such as sol-gel alpha alumina-based abrasive grains.

Alpha aluminum-based ceramic materials useful to this invention include those abrasive grains such as disclosed in U.S. Pat. Nos. 4,314,827; 4,518,397; 4,574,003; 4,623,364; 4,744,802; 4,770,671; 4,881,951; 5,011,508; 5,291,591; 5,201,916; and 5,304,331; and European Patent Application No. 228,856. Examples of fused alumina zirconia include abrasive grains such as disclosed in U.S. Pat. Nos. 3,781,408 and 3,893,826.

The abrasive grains to be used in this invention typically have an average particle size ranging from about 0.1 to 1500 micrometers, usually between about 0.1 to 750 micrometers. It is preferred that the abrasive particles have a Mohs' hardness of at least about 8, more preferably above 9.

The term abrasive grains also encompasses single abrasive particles bonded together to form an abrasive agglomerate. Abrasive agglomerates are described in U.S. Pat. Nos. 4,311,489; 4,652,275; and 4,799,939; which descriptions are incorporated herein by reference.

It is also within the scope of this invention to have a surface coating on the abrasive grains. The surface coating may have many different functions. In some instances the surface coatings increase adhesion to the binder or alter the abrading characteristics of the abrasive grain or particle. Examples of surface coatings include coupling agents, halide salts, metal oxides such as silica, refractory metal nitrides, and refractory metal carbides.

The abrasive grains of this invention also can embrace abrasive particles mixed or agglomerated with each other or diluent particles. The particle size of these diluent particles preferably is on the same order of magnitude as the abrasive grains or particles. Examples of such diluent particles include gypsum, marble, limestone, flint, silica grinding aids, glass bubbles, glass beads, aluminum silicate, and the like.

A preferred inorganic metaphosphate for use in this invention is sodium metaphosphate (i.e., $NaPO_3$), a crystalline material, that is also referred to in the field as "phosphate glass" or "Maddrell's salt". These terms are used interchangeably in this application to denominate $NaPO_3$. Sodium metaphosphate is essentially water insoluble. Compatibility with aqueous epoxy or phenolic resins can be enhanced by coupling agents and/or wetting agents. A coupling agent can provide an association bridge between the binder precursor and the inorganic metaphosphate, filler particles, and/or abrasive particles. Examples of coupling agents include silanes, titanates, and zircoaluminates, and their manner of use for this function is described, for example, in U.S. Pat. No. 4,871,376 (DeWald), which is incorporated herein by reference. The abrasive bond preferably contains from about 0.01 to 3 wt. % coupling agent.

One system used to enhance rheology for these resin/phosphate glass systems is an equal parts mixture of a titanate available from Kenrich Petrochemicals, Inc., Bayonne, N.J., under the trade designation "LICA 38", and nonyl-phenoxypoly(ethylene-oxy)ethanol available from Rhone-Poulenc, Inc., Cranbury, N.J., under the trade designation "IGEPAL CO-660". An aqueous slurry of an insoluble sodium metaphosphate can be treated with 0.625 parts of a LICA 38/IGEPAL CO-660 mixture per 100 parts of the phosphate glass. This treatment is applied in-situ prior to the addition of other components of the formulation such as thermosettable resin precursor, red iron oxide, filler, and so forth. Subsequently, this formulation is applied as a peripheral coating layer.

The filler may also contain a coupling agent. Examples of such coupling agents suitable for this invention include organosilanes, zircoaluminates, and titanates.

Insoluble phosphate glass-fatty acid salt particulate can be made by mixing the phosphate glass with an aqueous dispersion of a fatty acid salt. This mixture is thoroughly mixed and water added as necessary to facilitate dispersion of the materials. Then, ammonium hydroxide is added until this mixture gels. The gelled mass is dried at about 80° to 100° C., crushed, and screened to the desired size.

The inorganic phosphate grinding aid filler of the invention, as used in coated or slurry-coated abrasives, generally is incorporated into a peripheral coating being a size or supersize coat or an abrasive slurry, as applicable, in an amount of 10 to 90 wt. %, and preferably 20 to 70 wt. %, of the total coating weight (wet basis), and the peripheral coating binder generally is included in an amount of between 10 and 40 wt. %, preferably between 15 and 35 wt. % based on total coating weight (wet basis) of the size, supersize, or abrasive slurry. The mixing ratio, by dry weight (solids), of phosphate glass additive to peripheral coating binder in the peripheral coating layer is about 1:0.75 to about 2.25:1, respectively, for this invention.

The inorganic phosphate grinding aid particles generally have an average particle size of between 1 and 150 micrometers, and preferably between 5 and 100 micrometers, more preferably 5 to 50 micrometers.

Binders used to bind and consolidate a plurality of the inorganic phosphate particles used in the agglomerate form thereof include fatty acid metal salts, silica, and the thermosetting resins discussed above. The fatty acid is, in general, a long straight or substantially straight-chain hydrocarbon including a carboxylic acid group and at least 8 carbon atoms, preferably 8 to 20 carbon atoms. The fatty acid can be saturated or unsaturated. If the fatty acid is saturated, its salt can be represented by the formula $CH_3(CH_2)_xCO_2M$, where x can be between 6 and 18 and the metal atom M can be selected from the group consisting of zinc, calcium, lithium, aluminum, nickel, lead, barium and the like. If x is 16, then a stearate salt is formed; likewise if x is 14, a palmitate salt is formed; if x is 6, an octanoate salt is formed. The fatty acid can also be unsaturated, as in the case of a undecylenate salt, $CH_2{=}(CH_2)_8CO_2M$ and an oleate salt, $CH_3(CH_2)_7CH{=}CH(CH_2)_7CO_2M$. Stearic acid is the preferred fatty acid. A mixture of fatty acids can be used, such as that commonly encountered in currently-available commercial sources of "stearic acid".

The softening points of the above-described fatty acid salts are greater than 100° C. It is preferred in this invention to use metal salts of a fatty acid that have a high softening point. During abrading applications a considerable amount of heat can be generated. This heat may soften the loading-resistant coating to the point that the performance of the coated abrasive is substantially reduced and may cause the coating to smear on the workpiece being abraded. Metal stearates have a softening point in the range of 110°–212° C.

The metal salt of a fatty acid is in general insoluble in water and sparingly soluble in organic solvents, such as ketones, esters, alcohols, and mixtures thereof. However, if an appropriate surfactant is employed, the metal salt of a fatty acid can be rendered dispersible in water. It is preferred to use water as the solvent instead of organic solvents to minimize the environmental concerns associated with solvent removal. In general, the amount of the surfactant contained is between 0.01 to 10 wt. % of the total formulation of phosphate salt particulate, metal salt of fatty acid, and surfactant, that is to be used to make the agglomerate. Typical examples of surfactants which can be used are polyoxethylene alkylphenolether, sodium alkylsulfate, polyoxyethylene alkylester, polyoxyethylene alkylether, polyhydric alcoholesters, polyhydric esterethers, sulfonates, or sulfosuccinates. The suffactant can be added directly to the agglomerate-forming formulation, or the methyl salt of the fatty acid can be pretreated with the surfactant and then added to the formulation.

The agglomerate composite particulate grains with the inorganic phosphate salts can be prepared by stirring or otherwise mixing a dispersion of the inorganic phosphate salt particles, e.g., $NaPO_3$, in an aqueous solution or dispersion of the binder therefor, e.g., zinc stearate, $Zn(C_{18}H_{35}O_2)_2$, gelling the resulting mixture of particulate and binder, drying such mixture, and grinding, crushing, or otherwise pulverizing or shaping and classifying the resulting dry solid to form a composite particulate or grain product.

Colloidal silica or silica sol are also useful as binders for the inorganic phosphate particulates for making the agglomerate form thereof. These sols are stable dispersions of amorphous silica particles in water. Commercial products contain silica particles with diameters of about 3–100 nm and specific surface areas of 50–270 $m^2/g$, with silica contents of 15–50 wt. %. They contain small amounts (<1 wt. %) of stabilizers, most commonly sodium ions. Their pH should be above 7 to maintain the negative charges on the silica particles that prevent aggregation. This surface charge is neutralized by soluble salts that ionize and form a double layer around the silica surface, which then allows aggregation; therefore, sols are only stable at low salt concentration.

Also, the fatty acid metal binders and colloidal silica binders of the invention can be combined and used together as a binder for the agglomerate.

The agglomerates of the inorganic metaphosphates particles generally have an average size of between 20 and 750 micrometers, more preferably between 100 and 700 micrometers. In some instances, it is preferred that the agglomerate grains be the same size or about the same size as the abrasive grains.

It is within the scope of this invention to have (1) coated agglomerate grains along side of abrasive; (2) agglomerate grains coated underneath abrasive grains; (3) agglomerate grains coated over abrasive grains; and (4) combinations thereof.

The agglomerate grains including the inorganic phosphate generally comprise 5 to 90 wt. % phosphate salt particulate and 10 to 95 wt. % binder, and preferably 10 to 80 wt. % phosphate salt particulate and 20 to 90 wt. % binder.

The phosphate salt-containing agglomerates composite grains can further comprise optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired.

It is also within the scope of this invention to incorporate inorganic phosphate into both an agglomerate admixed into a peripheral coating and also directly with the main binder of a peripheral coating. In either instance, the particle size preferred is 30 microns or less.

The bond system of the coated abrasive article, viz. any of the make coat, size coat, abrasive slurry coat, or supersize coat, and the like, as applicable, also can contain such adjuvants with the primary component thereof, i.e., the binder precursor.

For example, although not required, grinding aids, in addition to the phosphate salt in the peripheral coating, can be used in the coated and slurry-coated abrasive articles of the invention, if desired. A grinding aid is defined as a particulate material that the addition of which has a significant effect on the chemical and physical processes of abrading which results in improved performance. In general, the addition of a grinding aid increases the useful life of the coated abrasive. Grinding aids encompass a wide variety of different materials and can be inorganic or organic based. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron, and titanium. Other miscellaneous grinding aids include sulfur, organic sulfur compounds, graphite and metallic sulfides. It is also within the scope of this invention to use a combination of different grinding aids. The above mentioned examples of grinding aids are meant to be a representative showing of grinding aids, and they are not meant to encompass all grinding aids usable in the present invention.

Examples of antistatic agents which can be incorporated into the make, size, supersize, or abrasive slurry coatings are graphite, carbon black, vanadium oxide, and humectants. These antistatic agents are described, for example, in U.S. Pat. Nos. 5,061,294; 5,137,542; and 5,203,884; which descriptions are incorporated herein by reference.

Another optional adjuvant for the make, size and/or supersize binder precursors are modifying particles which have the effect of lowering the binder precursor viscosity and reduce the rate of sedimentation of abrasive and/or filler particles in the binder precursors. Modifying particles are described in U.S. Pat. No. 5,368,619 (Culler), which is incorporated herein by reference. Preferred modifying particles include silica particles such as those available from the, Degussa Corp., Ridgefield Park, N.J., under the trade designations "OX-50", "R-812", and "P-820", the first being an amorphous silica having an average particle size of 40 millimicrometers and surface area of 50 $m^2/g$, the second being a hydrophobic fumed silica having an average particle size of 7 millimicrometers and surface area of 260 $m^2/g$, and the third being a precipitated silica having an average particle size of 15 millimicrometers and surface area of 100 $m^2/g$. The modifying particle generally is an inorganic particulate of relatively small particle size, preferably having an average particle size less than about 100 millimicrometers, more preferably less than about 50 millimicrometers. Modifying particles are preferably present in the slurries and binder precursor dispersions from about 0.01 dry weight percent to about 30 dry weight percent, more preferably from about 0.05 to about 10 weight percent, and most preferably from about 0.5 to about 5 weight percent.

The manipulative steps of the process for making a coated abrasive articles of the invention can be essentially the same as those currently practiced in the art. Coated abrasives generally consist of a backing, abrasive grains, and at least one binder to hold the abrasive grains to the backing. In general, the coated abrasive comprises a backing having a first bond system, commonly referred to as the make coat present on the front side of the backing. At least partially embedded into the make resin are the abrasive particles. Over the make coated abrasive particles is a second bond system, commonly referred to as a size coat. In some instances, a third coating or a supersize coat comprises the grinding aid and a binder. Methods of making the coated abrasive is described in U.S. Pat. Nos. 4,734,104 and 4,737,163, which both are incorporated herein by reference.

To make the coated abrasive of the invention, the make coat is applied in a liquid or flowable form to the front side of the backing. Next, a plurality of abrasive grains are projected, preferably by electrostatic coating, into the make coat. The resulting construction is at least partially cured. Notably, if a thermoplastic resin is used alone for any bond system, the thermoplastic resin can be dried in order to solidify. Thus, for the purpose of this application, the term "cure" refers to the polymerization, gelling, or drying procedure necessary to convert a binder precursor into a binder. Therefore, "at least partially curing" refers to at least partially polymerizing, gelling, or drying a binder precursor.

Then, the size coat is applied in a liquid or flowable form over the abrasive grains/make coat. The size coat, and if necessary, the make coat are fully cured. The make and size coats can be applied by any number of techniques such as roll coating, spray coating, curtain coating, and the like. An optional supersize coat containing resin binder can be further coated upon the size coat to reinforce the abrasive particle retention, if desired. The make and size coats can be cured either by drying or by exposure to an energy source such as thermal energy, or radiation energy including electron beam, ultraviolet light and visible light. The choice of the energy source will depend upon the particular chemistry of the resinous adhesive. In any event, the peripheral (outermost) coating of the coated abrasive article construction, whether it is the size or supersize, must contain the phosphate salt additive.

The abrasive article of the invention involving forming an abrasive slurry coat as the peripheral coat itself can be made by the steps of mixing a resinous binder precursor, the phosphate salt additive, and any other adjuvants, and then coating the resulting dispersion upon a substrate, followed by curing the binder to harden the coating. The abrasive slurry coat can take the form of a single thickness coating.

Alternatively, the abrasive slurry, before curing the binder, can be shaped to form a so-called "structured abrasive article" meaning an abrasive article wherein a plurality of shaped abrasive composites (binder plus abrasive particles, inorganic phosphate, and other additives distributed in the binder) are formed in the surface topography of the abrasive slurry. Slurry-shaping tooling equipment and modes of operation thereof can be used to shape the abrasive slurry in this regard, for example, such as those described in U.S. Pat. No. 5,152,917 (Pieper et al.), and U.S. Pat. No. 5,435,816 (Spurgeon et al.), which teachings both are incorporated herein by reference.

In a structured abrasive of this invention, abrasive composites are shaped, preferably precisely shaped, and comprise a plurality of abrasive particles, a binder, and the alkali metal or alkaline earth metal phosphate additive. The abrasive particles usable in abrasive composites of a structured abrasive of this invention are as described above. Suitable binders include cured binder precursors which include acrylate monomer(s), acrylated epoxies, acrylated isocyanates, acrylated isocyanurates, acrylated urethanes, and combinations thereof, such as those described above.

The precisely shaped composites may have the following shapes: pyramids, truncated pyramids, cones, ridges, or truncated cones, preferably pyramids.

One general method for making a structured abrasive article of this invention involves introducing an abrasive slurry comprising a binder precursor, abrasive particles, and the inorganic phosphate onto a production tool, wherein the production tool has a specified pattern.

The binder precursor is then at least partially gelled or cured, before the intermediate article is removed from the outer surface of the production tool, to form a structured coated abrasive article, which is then removed from the production tool.

If the production tool is made from a transparent material, e.g., a polypropylene or polyethylene thermoplastic, then either visible or ultraviolet light can be transmitted through the production tool and into the abrasive slurry to cure the binder precursor. This step is further described in U.S. Pat. No. 5,435,816 (Spurgeon et al.). Alternatively, if the backing is transparent to visible or ultraviolet light, visible or ultraviolet light can be transmitted through the backing to cure the binder precursor.

By at least partially curing on the production tool, the abrasive composite has a precise shape and predetermined pattern. However, the production tool can be removed before a precise shape has been achieved resulting in an abrasive composite that does not have a precise shape. The binder precursor can be further cured off the production tool.

The phrase "production tool" as used herein means an article containing cavities or openings therein. For example, the production tool may be a cylinder, a flexible web, or an endless belt. A backing is introduced onto the outer surface of the production tool after the cavities have been filled so that the abrasive slurry contained in the cavities wets one major surface of the backing to form an intermediate article. The binder precursor is then at least partially cured or gelled, before removing the intermediate article from the outer surface of the production tool. Alternatively, the abrasive slurry can be introduced onto the backing so that the abrasive slurry wets one major surface of the backing to form an intermediate article. The intermediate article is then introduced to a production tool having a specified pattern.

The production tool can be a belt, a sheet, a continuous sheet or web, a coating roll, a sleeve mounted on a coating roll or die. The outer surface of the production tool can be smooth or have a surface topography or pattern. The pattern will generally consist of a plurality of cavities or features. The resulting abrasive particle will have the inverse of the pattern from the production tool. These cavities can have any geometric shape such as a rectangle, semicircle, circle, triangle, square, hexagon, pyramid, octagon, etc. The cavities can be present in a dot-like pattern or continuous rows, or the cavities can butt up against one another.

The production tool can be made from metal or be made from a thermoplastic material. The metal tool can be fabricated by any conventional technique such as engraving, hobbing, electroforming, diamond turning and the like.

The following description outlines a general procedure for making a thermoplastic production tool. A master tool is first provided. If a pattern is desired in the production tool, then the master tool should also have the inverse of the pattern for the production tool. The master tool is preferably made out of metal, e.g., nickel. The metal master tool can be fabricated by any conventional technique such as engraving, hobbing, electroforming, diamond turning, etc. The thermoplastic material is then heated optionally along with the pattern. After the the thermoplastic material is embossed with the master tool pattern. After the embossing, the thermoplastic material is cooled to solidify.

A peripheral coating comprising a binder and an inorganic phosphate optionally can be at least partially coated over the abrasive composites. For example, if the abrasive composite is in the shape of a truncated pyramid, the peripheral coating could be coated on the tops of the truncated pyramid.

Another use of the inorganic phosphate in this invention is its inclusion in erodible agglomerates or bonded abrasives, such as those generally described in U.S. Pat. Nos. 4,311,489, 4,652,275, and 4,799,939, each of which is incorporated herein by reference.

The inorganic phosphate, and/or as included in erodible agglomerates, also can be incorporated into lofty, open nonwoven abrasives, such as those prepared according to the teachings of U.S. Pat. Nos. 2,958,593; 4,991,362; and U.S. Pat. No. 5,025,596, all of which are hereby incorporated by reference. In general, nonwoven abrasives include open, lofty, three-dimensional webs of organic fibers bonded together at points where they contact by an abrasive binder. These webs may be roll coated, spray coated, or coated by other means with binder precursor compositions including the inorganic phosphate grinding aid particles, and/or erodible agglomerates including same, and subsequently subjected to conditions sufficient to cure the resin.

A general procedure for making a nonwoven abrasive incorporating the inorganic phosphate includes mixing together binder precursor, abrasive particles, the inorganic phosphate(and/or erodible grinding aid agglomerates including the combination), and other optional additives or supplemental binder (such as a PVC plastisol) to form a homogeneous mixture. This mixture is then sprayed or coated into a fibrous, lofty, nonwoven substrate. The binder precursor is then cured to form the nonwoven abrasive.

The abrasive products of the present invention are not limited as to the types of workpiece that can be abraded therewith. By "abrading", the term as used herein generally can mean any of grinding, polishing, finishing, and the like. The workpiece surfaces made of wood, metal, metal alloy, plastic, ceramic, stone, and the like, can be abraded by the coated abrasive products of the present invention. The abrasive products of this invention are particularly well-suited for metal grinding operations, especially titanium grinding.

Also, the abrasive products of the present invention can be readily converted into various geometric shapes to suit the contemplated application, such as discrete sheets, disc forms, endless belt forms, conical forms, and so forth, depending on the particular abrading operation envisioned. The abrasive articles can be flexed and/or humidified prior to use.

In the following examples, objects and advantages of this invention are further illustrated by various embodiments thereof but the details of those examples should not be construed to unduly limit this invention. All parts and percentages therein are by weight unless otherwise indicated.

EXAMPLES

In the examples, either of two different Abrasive Efficiency Test Procedures, I or II, were used to evaluate coated abrasive products (belts or discs) described in the examples. The abrasive testing procedures and methods for making the belts and discs will first be described.

Abrasive Efficiency Test Procedure I

Fibre discs of coated abrasive products, each disc having a diameter of 17.8 cm, with a 2.2 cm diameter center hole and backing thickness of0.76 mm, were installed on a swing-arm testing machine. The fibre discs were first conventionally flexed to controllably break the hard bonding resins, mounted on a beveled aluminum back-up pad, and used to grind the edge of a titanium disc workpiece. Each disc was driven at 1710 rpm while the portion of the disc overlaying the beveled edge of the back-up pad contacted with workpiece at 4.0 kg pressure, unless indicated otherwise in the following examples. Each disc was used to grind the same workpiece for a total of 8 minutes or 10 minutes as indicated in the following examples, and the workpiece was preweighed and then weighed after every 1 minute of grinding.

Abrasive Efficiency Test Procedure II

The abrasive product to be evaluated was converted into two 7.6 cm×335 cm endless abrasive belts which were tested on a constant-load surface grinder. Two belt samples from each example abrasive product were tested. A pre-weighed, titanium workpiece, approximately 2.5 cm×5 cm×18 cm, was mounted in a holder, positioned vertically, with the 2.5 cm×18 cm face confronting an approximately 36 cm diameter, 60 Shore A durometer serrated rubber, contact wheel and one-on-one lands over which entrained the coated abrasive belt. The workpiece was then reciprocated vertically through a 18 cm path at the rate of 20 cycles per minute, while a spring-loaded plunger urged the workpiece against the belt with a load of 11.0 kg as the belt was driven at about 2,050 m per minute. After 15 seconds of grinding time had elapsed, the workpiece holder assembly was removed and reweighed, and the amount of stock abrasively removed from the workpiece was calculated by subtracting the weight thereof after abrading from the original weight. Then a new, pre-weighed workpiece and holder were mounted on the equipment. The cut results reported in the tables below for Test Procedure II are an average value of the two belt samples thereof tested for each example. The experimental error on this test was about ±10%. The total cut is a measure of the total amount of titanium removed during the test. The test was deemed ended after three (3) minutes of grinding.

For purposes of Test Procedures I and II described herein, in general, the initial cut is the amount of the workpiece removed upon completion of the first prescribed interval of grinding; the final cut is the amount of workpiece removed in the last interval of grinding; and the total cut is the total amount of workpiece removed over the entire grinding procedure for the subject workpiece.

MATERIALS DESCRIPTION

The following materials and descriptions thereof are used in the examples.

Epoxy Resins

BPAW: a composition containing a diglycidyl ether of bisphenol A epoxy resin coatable from water containing approximately 60% solids and 40% water. This composition, which had the trade designation "CMD 35201", was purchased from Shell Chemical Co., Louisville, Ky. This composition also contained a nonionic emulsifier. The epoxy equivalent weight ranged from about 600 to about 700.

EPR: A composition containing a diglycidyl ether of bisphenol A epoxy resin coatable from an organic solvent. This composition, which had the trade designation "EPON 828", was purchased from the Shell Chemical Company, Houston, Tex. The epoxy equivalent weight ranged from about 185 to about 195.

Phenolic Resin

RPI: a resole phenolic resin with 75% solids (non-volatile).

APR: an acidified resole phenolic resin formulation consisting of 96.3% resole phenolic resin, 3.4% PTSA (defined elsewhere herein), and 0.3% $AlCl_3$ solution (defined elsewhere herein).

Radiation Curable Resin Components & Additives

MSCA: gamma-methacryloxypropyltrimethoxysilane, known under the trade designation "A-174", from Union Carbide Chemicals and Plastics Co., Danbury, Conn.

ASP: amorphous silica particles having an average surface area of 50 $m^2/g$, and average particle size of 40 millimicrometers, commercially available from Degussa Corp., Ridgefield Park, N.J., under the trade designation "OX-50".

TATHEIC: triacrylate of tris(hydroxyethyl)isocyanurate.

TMPTA: trimethylol propane triacrylate.

PH1: 2,2-dimethoxy-1-2-diphenyl-1-ethanone, commercially available from Ciba Geigy Corp., Hawthorne, N.Y., under the trade designation "IRGACURE 651".

Plasticizers

S-141: a diphenyl alkyl phosphate plasticizer, commercially available from Monsanto Co., St. Louis, Mo., under the trade designation "Santicizer 141".

DiNP: diisononyl phthalate plasticizer, commercially available from Exxon Chemical Co., Houston, Tex.

Thermoplastic

OXY-0565: a vinyl chloride/vinyl acetate copolymer commercially available from Occidental Chemical Corp. Dallas, Tex., under the trade designation "OXY-0565".

Curing Agents/Catalysts

EMI: 2-ethyl-4-methyl imidazole. This curing agent, which had the designation "EMI-24", was commercially available from Air Products, Allentown, Pa.

SbLAC: a complexed, latent Lewis Acid made by dissolving $SbF_5$ in diethylene glycol followed by forming a complex with an equivalent excess of 2,6-diethyl aniline.

PTSA: 65% para-toluene sulfonic acid in water.

$AlCl_3$: 28% aluminum chloride in water.

Grinding Aids $KBF_4$: 98% pure micropulverized potassium tetrafluoroborate, in which 95% by weight passes through a 325 mesh screen and a 100% by weight passes through a 200 mesh screen.

$AlPO_4$: aluminum phosphate.

$Ca(H_2PO_4)_2$: calcium dihydrogen phosphate.

PhG: Phosphate glass, i.e., sodium metaphosphate ($NaPO_3$), a water insoluble crystalline particulate, commercially available from Sigma Chemical Co., St. Louis, Mo.

$Na_3AlF_6$: cryolite (trisodium hexafluoroaluminate).

Additives

I0: red iron oxide

HP: a mixture of 85% 2-methoxy propanol and 15% $H_2O$ commercially available from Worum Chemical Co., St. Paul, Minn.

Dispersing Agent

AOT: a dispersing agent (sodium dioctyl sulfosuccinate), which had the trade designation "Aerosol OT" was commercially available from Rohm and Haas Company, Philadelphia, Pa.

Filler $CaCO_3$: calcium carbonate

In the following examples, various abrasive articles of the invention are described. General procedures for making these abrasive products will first be described.

General Procedure for Making Coated Abrasives Discs

A coated abrasive disc was prepared according to the following procedure. A 0.76 mm thick vulcanized fibre backing having a 2.2 cm diameter center hole was coated with a calcium carbonate-filled resole phenolic resin, comprising 69 parts resole phenolic resin (70 wt. % solids), 52 parts non-agglomerated $CaCO_3$ (dry weight basis), and enough of a solution of 90 parts water/10 parts ethylene glycol monoethyl ether to form a make coat having 83 wt. % total nonvolatile solid content. The wet coating weight of the make coat was approximately 161 g/m$^2$. Grade 36 (ave. diameter approximately 650 micrometers) silicon carbide abrasive grains were electrostatically coated onto the make coat at a weight of approximately 695 g/m$^2$. The resulting abrasive article was precured for 150 minutes at 93° C. A size composition was applied over the abrasive grains and the make coat at an average weight of approximately 605 g/m$^2$ to form a size coat prior to testing. Unless indicated otherwise in the examples below, the size coat consisted of 32% RP1, 51.7% $CaCO_3$ and 16.3% HP. The resulting product was cured for 11.5 hours at 93° C. After this step, the coated abrasive discs were flexed and humidified at 45% RH for one week.

General Procedure for Making Structured Coated Abrasive Articles

The abrasive articles employing slurries of the invention were made generally in accordance with assignee's U.S. Pat. No. 5,435,816 (Spurgeon et al.). First, a slurry was prepared by thoroughly mixing: 22.3 parts by weight binder resin composition (70/30/1 of TMPTA/TATHEIC/PH1), 0.85% ASP, 1.1% MSCA, 58.7% abrasive grains (of the type indicated in the examples) and 17.1% inorganic filler (of the type indicated in the example). The slurry used in preparing abrasive product was coated into a production tool with a random pitch pattern. The height of this pattern was 14 mil (356 micrometers). This pattern was the same pattern as described in the examples of U.S. patent application Ser. No. 08/120,300 (corresponding to PCT Publ. No. 95/07797, published March 23, 1995), which is incorporated herein by reference. The production tool was made from polypropylene.

Next, a J-weight rayon cloth was pressed against the production tool by means of a roller so that the slurry wetted the front surface of the cloth. This J-weight rayon backing had a dried phenolic/latex presize.

Ultraviolet light was then transmitted through the polypropylene tool and into the slurry. The ultraviolet light initiated the polymerization of the radiation curable resin contained in the slurry, resulting in the slurry being transformed into an abrasive composite, with the abrasive composite being adhered to the cloth backing. The ultraviolet light sources used were two Fusion Systems "D" bulbs, which operated at 600 watts/in (236 watts/cm) of bulb width. Finally, the cloth/abrasive composite or structured abrasive was separated from the polypropylene production tool, providing a coated abrasive article.

Example 1 and Comparative Examples A–E

The coated abrasives for Example 1 and Comparative Examples A–E were made according to the General Procedure for Making Coated Abrasives Discs. These examples compare the abrading characteristics of a coated abrasive article of this invention using phosphate glass in a supersize peripheral coating as compared to other grinding aids and a control using no supersize. After cure of the make and size coats, supersizes were applied as shown in Table 1 with the following composition: 29.2% BPAW, 0.35% EMI, 53.3% of the supersize filler as indicated, 14.1% water, 0.75% AOT, and 2.3% IO (all percentages by wt.). Table 1 also indicates the total wt. % solids and coating rate for the various supersizes examined. The phosphate supersizes were further diluted with water to decrease viscosity and enhance coatability. After standard cure of the supersized discs, the discs containing $Ca_{10}(PO_4)_6(OH)_2$ had noticeable cracks. Following flexing and humidifying of these supersized discs, the discs were tested for grinding performance using Test Procedure I and the results are displayed in Table 2. The initial, final and total cuts (over 8 minutes) are reported in Table 2 in grams (g). The % of Comp. Ex. C value in Table 2 is based on the total cut value of the given example relative to the total cut value for Comparative Example C.

TABLE 1

| | Filler | Wt. % Solids | Wet Wt. (g/m$^2$) |
|---|---|---|---|
| Comp. Ex. A | $AlPO_4$ | 66 | 375 |
| Comp. Ex. B | $KBF_4$ | 76 | 323 |
| Comp. Ex. C | NONE | — | — |
| Comp. Ex. D | $Ca(H_2PO_4)_2$ | 76 | 327 |
| Comp. Ex. E | $Ca_{10}(PO_4)_6(OH)_2$ | 63 | 452 |
| Example 1 | PhG | 76 | 331 |

TABLE 2

| | Initial Cut | Final Cut | Total Cut | % of Comp. Ex. G |
|---|---|---|---|---|
| Comp. Ex. A | 2.1 | 0.8 | 9.1 | 111 |
| Comp. Ex. B | 2.4 | 1.1 | 11.4 | 139 |
| Comp. Ex. C | 1.9 | 0.8 | 8.2 | 100 |
| Comp. Ex. D | 2.3 | 1.0 | 10.6 | 129 |
| Comp. Ex. E | 2.0 | 0.7 | 8.5 | 104 |
| Example 1 | 2.3 | 1.1 | 11.7 | 143 |

The disc of Example 1 with the phosphate glass-containing supersize performed 143% of discs without supersize (i.e., Comparative Example C), and was superior to all the grinding aids of Comparative Examples A, B, D and E. It is to be noted that Comparative Example A, with $AlPO_4$, is "comparative" in the limited sense as relative to a preferred embodiment of the invention as exemplified by Example 1. Inclusion of Group IIIA metal orthophosphates in a peripheral coating of a coated abrasive article is within the scope of another aspect of the invention.

Example 2 and Comparative Examples F–H

The coated abrasives for Example 2 and Comparative Examples F–H were made according to the General Procedure for Making Coated Abrasives Discs except the size coat was applied in a wet rate indicated in Table 3 and the size formulations each were 50 g RP1, plus the filler in the amount indicated in Table 3; the mixture being diluted to 44 wt. % solids. Comparative Example H using $CaCO_3$ filler was designated the control for this series of examples. No supersize was applied so that the size coat represented the peripheral coat of the coated abrasive. The type of filler added to the size coat is indicated in Table 3.

After final cure (no supersize), flexing, and humidification of these discs, Test Procedure I was used to test the discs for grinding performance and the results are displayed in Table 4. The initial, final, and total cuts (over 10 minutes) are reported in Table 4 in grams (g). The % of Comp. Ex. H value in Table 4 is based on the total cut value of the given example relative to the total cut value of Comp. Ex. H.

TABLE 3

| | Filler | Filler amount (g) | Wet wt. (g/m$^2$) |
|---|---|---|---|
| Comp. Ex. F | $AlPO_4$* | 37.5 | 16.1 |
| Comp. Ex. G | $Na_3AlF_6$ | 43.5 | 16.2 |
| Comp. Ex. H | $CaCO_3$ | 43.5 | 16.3 |
| Example 2 | PhG | 43.5 | 16.8 |

*precoated with mineral oil

TABLE 4

| | Initial Cut | Final Cut | Total Cut | % of Comp. Ex. H |
|---|---|---|---|---|
| Comp. Ex. F | 2.1 | 0.9 | 12.5 | 116 |
| Comp. Ex. G | 2.2 | 0.9 | 11.4 | 122 |
| Comp. Ex. H | 2.1 | 0.8 | 10.8 | 100 |
| Example 2 | 2.4 | 1.2 | 15.5 | 144 |

The disc of Example 2 with phosphate glass in the phenolic size performed 144% of the disc with $CaCO_3$ filler in the phenolic size (i.e., Comp. Ex. H) while the disc with cryolite ($Na_3AlF_6$) in the phenolic size (Comp. Ex. G) only performed 122% of Comp. Ex. H. The remarks made supra relative to Comparative Example A are similarly applicable to Comparative Example F.

Examples 3–4 and Comparative Examples I–K

The following examples were conducted to examine the use of phosphate glass in plastisol-based supersize coats. The discs were made according to the General Procedure for Making the Coated Abrasives Discs, except that grade 50 (ave. diameter approximately 430 micrometers) SiC was used as the abrasive grains.

Preparation of Plastisols

Into a Hobart or Kitchen Aid "bread dough mixer" was placed 210 parts plasticizer (either DiNP or S-141). With stirring was added 280 parts OXY-0565. After 20 to 30 minutes of stirring, the mix was ready for the addition of further additives (e.g. inorganic filler, stabilizer, curable resin, and so forth). This gave 100% solids with viscosities varying broadly. Plastisols used for supersizing in Comparative Example K and Examples 3–4 had the specific formulations shown in Table 5. Comparative Example I had no supersize applied to the size coat. Comparative Example J had an aqueous epoxy supersize formulation applied at 4.0 $g/m^2$ comprising 29.2% BPAW, 0.35% EMI, 53.3% $KBF_4$, 14.1% water, 0.75% AOT, and 2.3% IO (all percentages by wt.).

Supersizing of discs

The supersize formulations, if any, were brushed over the cured size on discs, and cured at 90° to 100° C. Test Procedure I was used to test grinding performance and the results are displayed in Table 6. The initial, final, and total cuts (over 10 minutes) are reported in Table 6 in grams (g). The % of Comp. Ex. I value in Table 6 is based on the total cut value of the given example relative to the total cut value of Comp. Ex. I.

TABLE 5

| Ingredient | Comp. Ex. K | Ex. 3 | Ex. 4 |
|---|---|---|---|
| OXY-0565 | 40 | 30.5 | 25 |
| DiNP | — | 23 | — |
| S-141 | 31 | — | 17 |
| EPR | 28.3 | 23 | 40 |
| SbLAC | 0.7 | 0.5 | 1 |
| PhG | — | 23 | 17 |

Comparative Example K had a wet coating rate of 6.7 $g/m^2$; Example 3 had a wet coating rate of 7.1 $g/m^2$; and Example 4 had a wet coating rate of 5.0 $g/m^2$.

TABLE 6

| | Initial Cut | Final Cut | Total Cut | % of Comp. Ex. I |
|---|---|---|---|---|
| Comp. Ex. I | 1.6 | 0.5 | 7.0 | 100 |
| Comp. Ex. J | 1.7 | 0.8 | 8.3 | 118 |
| Comp. Ex. K | 2.0 | 1.4 | 11.7 | 167 |
| Ex. 3 | 1.7 | 1.4 | 11.2 | 161 |
| Ex. 4 | 2.7 | 1.1 | 12.7 | 181 |

The results summarized in Table 6 show that plastisols can be formulated with phosphate glass to perform relatively well as grinding aid supersizes on coated abrasives.

Example 5 and Comparative Example L

The coated abrasives for Example 5 and Comparative Example L were made according to the General Procedure for Making Coated Abrasives Discs except that the make coat was applied at a rate of 95 $g/m^2$, Grade 100 SiC was applied to the make at a rate of 323 $g/m^2$, and the size was applied at a rate of 242 $g/m^2$. Comparative Example L had no supersize, while Example 5 had a supersize formulation applied comprising 46 wt. % PhG and 54 wt. % APR applied at a wet rate of about 488 $g/m^2$. Following flexing and humidifying of these discs, the disc Test Procedure I was used to test the discs for grinding performance and the results are displayed in Table 7. The initial, final, and total cuts (over 10 minutes) are reported in Table 7 in grams (g). The % of Comp. Ex. L were based on total cut of the given example relative to the total cut of Comparative Example L.

TABLE 7

| | Initial Cut | Final Cut | Total Cut | % of Comp. Ex. L |
|---|---|---|---|---|
| Comp. Ex. L | 1.1 | 0.4 | 4.5 | 100 |
| Ex. 5 | 1.7 | 0.6 | 7.0 | 155 |

The discs of Example 5 with phosphate glass in the phenolic supersize peripheral coat performed 155% of the discs of Comparative Example L lacking such a supersize coat.

Examples 6–7 and Comparative Example M

The use of phosphate glass was also investigated in a structured abrasive article. The slurry composition for Example 6 had this composition: 32.7% parts binder resin composition (70:30:1 of TMPTA/TATHEIC/PH1), 0.7% ASP, 1.5% MSCA, 50.4% Grade 180 SiC, and 14.7% PhG (all percentages by wt.). The slurry composition for Example 7 had this composition: 31.3% parts binder resin composition (70:30:1 of TMPTA/TATHEIC/PH1), 0.8% ASP, 1.6% MSCA, 55.5% Grade 180 SiC, and 10.8% bone ash (i.e., an ash composed principally of $Ca_{10}(PO_4)_6(OH)_2$) (all percentages by wt.). The structured coated abrasive article of each of Example 6 and Example 7 was made by the General Procedure for Making Structured Abrasive Articles. No additional coatings were applied to the abrasive slurry coating. Comparative Example M was a Grade 150, J weight, cloth belt, commercially available from Minnesota Mining & Manufacturing Co., St. Paul, Minn., under the trade designation "Tri-M-ite Resinbond". The abrasive belts were tested on titanium under constant rate conditions according to Test Procedure II. The results are summarized in Table 8 with the cut values reported in grams (g) and compared to the total cut value of Comparative Example M.

TABLE 8

| | Initial Cut | Final Cut | Total Cut | % of Comp. Ex. M |
|---|---|---|---|---|
| Comp. Ex. M | 1.3 | 0.4 | 7.5 | 100 |
| Ex. 6 | 0.7 | 0.7 | 9.7 | 130 |
| Ex. 7 | 0.8 | 0.5 | 8.7 | 115 |

The structured abrasive of Example 6 containing the phosphate glass in the abrasive slurry peripheral coating was not only fully operable but outperformed the comparative commercial product of Comparative Example M. Example 7 containing bone ash as the inorganic phosphate additive also outperformed Comparative Example M.

Various modifications and alterations of this invention will become apparent to those skilled in the art from the foregoing description without departing from the scope and spirit of this invention.

What is claimed is:

1. An abrasive article comprising:

(a) a plurality of abrasive particles, (b) at least one binder to which said plurality of abrasive particles are adhered; and (c) a peripheral coating comprising an inorganic phosphate selected from the group consisting of an alkali metal metaphosphate, an alkaline earth metal metaphosphate, and a Group IIIA metal orthophosphate.

2. The abrasive article of claim 1, wherein said peripheral coating further comprises a thermosetting binder or a thermoplastic binder.

3. The abrasive article of claim 2, wherein said thermoplastic binder is polyvinylchloride.

4. The abrasive article of claim 1, wherein said peripheral coating further comprises a plasticized polyvinylchloride and a thermosetting resin.

5. The abrasive article of claim 1, wherein said inorganic phosphate is incorporated into a plurality of erodible grinding aid agglomerates adhered together by a thermosetting resin, said agglomerates being incorporated into at least one binder.

6. The abrasive article of claim 1, wherein said inorganic phosphate is sodium metaphosphate.

7. A coated abrasive article comprising:

(a) a substrate, (b) a make coat, (c) a plurality of abrasive articles adherently bonded to the make coat, and (d) a peripheral coating layer comprising an inorganic phosphate, wherein said inorganic phosphate is selected from the group consisting of an alkali metal metaphosphate, an alkaline earth metal metaphosphate, and a Group IIIA metal orthophosphate.

8. The coated abrasive article of claim 7, wherein the peripheral coating layer is a size coat.

9. The coated abrasive article of claim 8, wherein the inorganic phosphate and a binder of the size coat are present in a ratio ranging from about 1:0.75 to about 2.25:1.

10. The coated abrasive article of claim 7, wherein said peripheral coating layer further comprises a binder selected from the group consisting of phenolic resins, aminoplast resins having pendant α,β-unsaturated carbonyl groups, urethane resins, epoxy resins, ethylenically-unsaturated resins, acrylated isocyanurate resins, urea-formaldehyde resins, isocyanurate resins, acrylated urethane resins, acrylated epoxy resins, bismaleimide resins, fluorene modified epoxy resins, waxes, and mixtures thereof.

11. The coated abrasive article of claim 7, wherein said peripheral coating layer further comprises a plasticized polyvinyl chloride binder.

12. The coated abrasive article of claim 7, wherein said peripheral coating layer further comprises a thermosetting resin and plasticized polyvinyl chloride binder.

13. The coated abrasive article of claim 7, wherein said inorganic phosphate has an average particle size of between 1 and 150 micrometers.

14. The coated abrasive article of claim 7, wherein said inorganic phosphate has an average particle size of between 5 and 100 micrometers.

15. A coated abrasive article comprising a cured abrasive slurry coating comprising a plurality of abrasive grains, a binder, and an inorganic phosphate selected from the group consisting of an alkali metal metaphosphate, an alkaline earth metal metaphosphate, and a Group IIIA metal orthophosphate.

16. The coated abrasive article of claim 15, wherein said cured abrasive slurry comprises a plurality of composites each having a three-dimensional shape.

17. A method for making a coated abrasive article, comprising the steps of:

(a) applying a first binder resin precursor to a substrate;

(b) at least partially embedding a plurality of abrasive particles in said first binder resin precursor;

(c) at least partially curing said first binder resin precursor to form a make coat;

(d) applying, over said make coat and said plurality of abrasive particles, a second binder resin precursor and an inorganic phosphate selected from the group consisting of an alkali metal metaphosphate, an alkaline earth metal metaphosphate, and a Group IIIA metal orthophosphate; and (e) curing said second binder resin precursor to form a peripheral coating, and completely curing said first binder resin precursor.

18. A method for making a coated abrasive article, comprising the steps of:

(a) applying a first binder resin precursor to a substrate;

(b) at least partially embedding a plurality of abrasive particles in said first binder resin precursor;

(c) at least partially curing said first binder resin precursor to form a make coat;

(d) applying, over said make coat and said plurality of abrasive particles, a second binder resin precursor; and (e) at least partially curing said second binder resin precursor to form a size coat;

(f) applying, over said size coat, a third binder resin precursor and an inorganic phosphate selected from the group consisting of an alkali metal metaphosphate, an alkaline earth metal metaphosphate, and a Group IIIA metal orthophosphate; and (g) curing said third binder resin precursor to form a peripheral coating, and completely curing said first and second binder resin precursors.

19. A method for making a slurry-coated abrasive article, comprising the steps of:

(a) applying a coating to a substrate, the coating comprising a binder resin precursor, a plurality of abrasive particles, and an inorganic phosphate selected from the group consisting of an alkali metal metaphosphate, an alkaline earth metal metaphosphate, and a Group IIIA metal orthophosphate; and (b) curing said binder resin precursor.

20. The method of claim 19, further comprising the step of shaping said coating after said applying step and before said curing step into three-dimensional shapes.

21. The method of claim 19, wherein said three-dimensional shapes are pyramids.

22. The bonded abrasive article of claim 21, wherein said shaped mass is a wheel.

23. A method of using an abrasive article to grind titanium, comprising:

(a) providing an abrasive article comprising an inorganic phosphate selected from the group consisting of an alkali metal metaphosphate, an alkaline earth metal metaphosphate, and a Group IIIA metal orthophosphate in a peripheral coating layer thereof; and a workpiece comprising titanium;

(b) frictionally engaging said peripheral coating layer of said abrasive article with a surface of said workpiece; and (c) moving at least one of said abrasive article and said workpiece relative to each effective to reduce the surface of said workpiece.

24. The abrasive article of claim 5, wherein said inorganic phosphate is sodium metaphosphate.

25. A coated abrasive article comprising:

(a) a substrate, (b) a make coat, (c) a plurality of abrasive particles adherently bonded to the make coat, (d) a size coat, and (e) a supersize coat comprising an inorganic phosphate, wherein said inorganic phosphate is selected from the group consisting of an alkali metal metaphosphate, an alkaline earth metal metaphosphate, and a Group IIIA metal orthophosphate.

26. The coated abrasive article of claim 25, wherein the inorganic phosphate and a binder of the supersize coat are present in a ratio ranging from about 1:0.75 to about 2.25:1.

27. The coated abrasive article of claim 25, wherein a binder of the supersize coat is selected from the group consisting of phenolic resins, aminoplast resins having pendant α,β-unsaturated carbonyl groups, urethane resins, epoxy resins, ethylenically-unsaturated resins, acrylated isocyanurate resins, urea-formaldehyde resins, isocyanurate resins, acrylated urethane resins, acrylated epoxy resins, bismaleimide resins, fluorene modified epoxy resins, waxes, and mixtures thereof.

28. The coated abrasive article of claim 25, wherein the supersize coat comprises a plasticized polyvinyl chloride binder.

29. The coated abrasive article of claim 25, wherein the supersize coat comprises a thermosetting resin and a plasticized polyvinyl chloride binder.

30. The coated abrasive article of claim 25, wherein said inorganic phosphate has an average particle size of between 1 and 150 micrometers.

31. The coated abrasive article of claim 25, wherein said inorganic phosphate has an average particle size of between 5 and 100 micrometers.

32. An abrasive article comprising:

(a) a plurality of abrasive particles, (b) a first binder to which said plurality of abrasive particles are adhered; and the first binder comprising a plurality of erodible grinding aid agglomerates, the agglomerates comprising a second binder and an inorganic phosphate selected from the group consisting of an alkali metal metaphosphate, an alkaline earth metal metaphosphate, and a Group IIIA metal orthophosphate.

33. A coated abrasive article comprising:

(a) a substrate, (b) a make coat, (c) a plurality of abrasive particles adherently bonded to the make coat, and (d) a size coat;

wherein the size coat comprises a plurality of erodible grinding aid agglomerates, the agglomerates comprising a binder and an inorganic phosphate, wherein said inorganic phosphate is selected from the group consisting of an alkali metal metaphosphate, an alkaline earth metal metaphosphate, and a Group IIIA metal orthophosphate.

34. A coated abrasive article comprising a cured abrasive slurry coating comprising a plurality of abrasive grains and a first binder, the cured slurry further comprising a plurality of erodible grinding aid agglomerates, the agglomerates comprising a second binder and an inorganic phosphate selected from the group consisting of an alkali metal metaphosphate, an alkaline earth metal metaphosphate, and a Group IIIA metal orthophosphate.

35. The coated abrasive article of claim 34, wherein said cured abrasive slurry comprises a plurality of composites each having a three-dimensional shape.

36. A nonwoven abrasive article comprising an open, lofty web bonded together by a binder, the binder bonding a plurality of abrasive particles to the web, wherein the binder comprises an inorganic phosphate selected from the group consisting of an alkali metal metaphosphate, an alkaline earth metal metaphosphate, and a Group IIIA metal orthophosphate.

37. A nonwoven abrasive article in accordance with claim 36, wherein the inorganic phosphate is incorporated into a plurality of erodible grinding aid agglomerates, the agglomerates further comprising a binder.

38. A coated abrasive article comprising a plurality of shaped abrasive composites, said composites comprising a binder, a plurality of abrasive grains, and an inorganic phosphate selected from the group consisting of an alkali metal metaphosphate, an alkaline earth metal metaphosphate, and a Group IIIA metal orthophosphate.

* * * * *